United States Patent [19]

Edwall

[11] 4,363,485

[45] Dec. 14, 1982

[54] TIME BASED PINBALL GAME MACHINE

[75] Inventor: Allen G. Edwall, Elk Grove, Ill.

[73] Assignee: D. Gottlieb & Co., Northlake, Ill.

[21] Appl. No.: 174,029

[22] Filed: Jul. 31, 1980

[51] Int. Cl.[3] ..... A63F 7/00
[52] U.S. Cl. ..... 273/121 A
[58] Field of Search ..... 273/118 A, 119 A, 120 A, 273/121 A, 85 G, DIG. 28, 237, 138 A

[56] References Cited

U.S. PATENT DOCUMENTS

| | | | |
|---|---|---|---|
| 2,015,293 | 9/1935 | Shyvers | 273/121 |
| 3,275,324 | 9/1966 | Burnside | 273/126 |
| 3,778,062 | 12/1973 | Sherwood | 273/121 A |
| 4,093,232 | 6/1978 | Nutting et al. | 273/121 A |
| 4,162,792 | 7/1979 | Chang et al. | 273/85 G |
| 4,162,793 | 7/1979 | Cummings | 273/121 A |
| 4,272,649 | 6/1981 | Pfeiffer | 273/121 A |

FOREIGN PATENT DOCUMENTS

| | | | |
|---|---|---|---|
| 1422335 | 1/1965 | France | 273/121 A |

OTHER PUBLICATIONS

The "Travel Time" Pinball Game Schematic, Jun. 1972.

*Primary Examiner*—Vance Y. Hum
*Assistant Examiner*—Leo P. Picard
*Attorney, Agent, or Firm*—Arnold, White & Durkee

[57] ABSTRACT

A pinball game has game play determined primarily by time rather than the number of ball plays. A specifiable amount of game play time is originally accorded to a given player. The game play time is reduced at an instantaneous rate which changes according to how actively he plays and scores. The more active the ball play, the slower the game play time is reduced. In another feature, the pinball game machine is controlled by a digital processor which also participates as a contestant against the human player. As another feature, upon certain playfield achievements, a given player is entitled to operate a mechanism which alters the playfield conditions of another player. Yet another feature includes the provision of multiple independent playfield areas on a common playfield. Each playfield area is self-contained, having its own captured ball, flipper mechanism, and scoring targets. Preferably, the areas having the captured balls are enabled for ball play only for specified periods of time.

47 Claims, 15 Drawing Figures

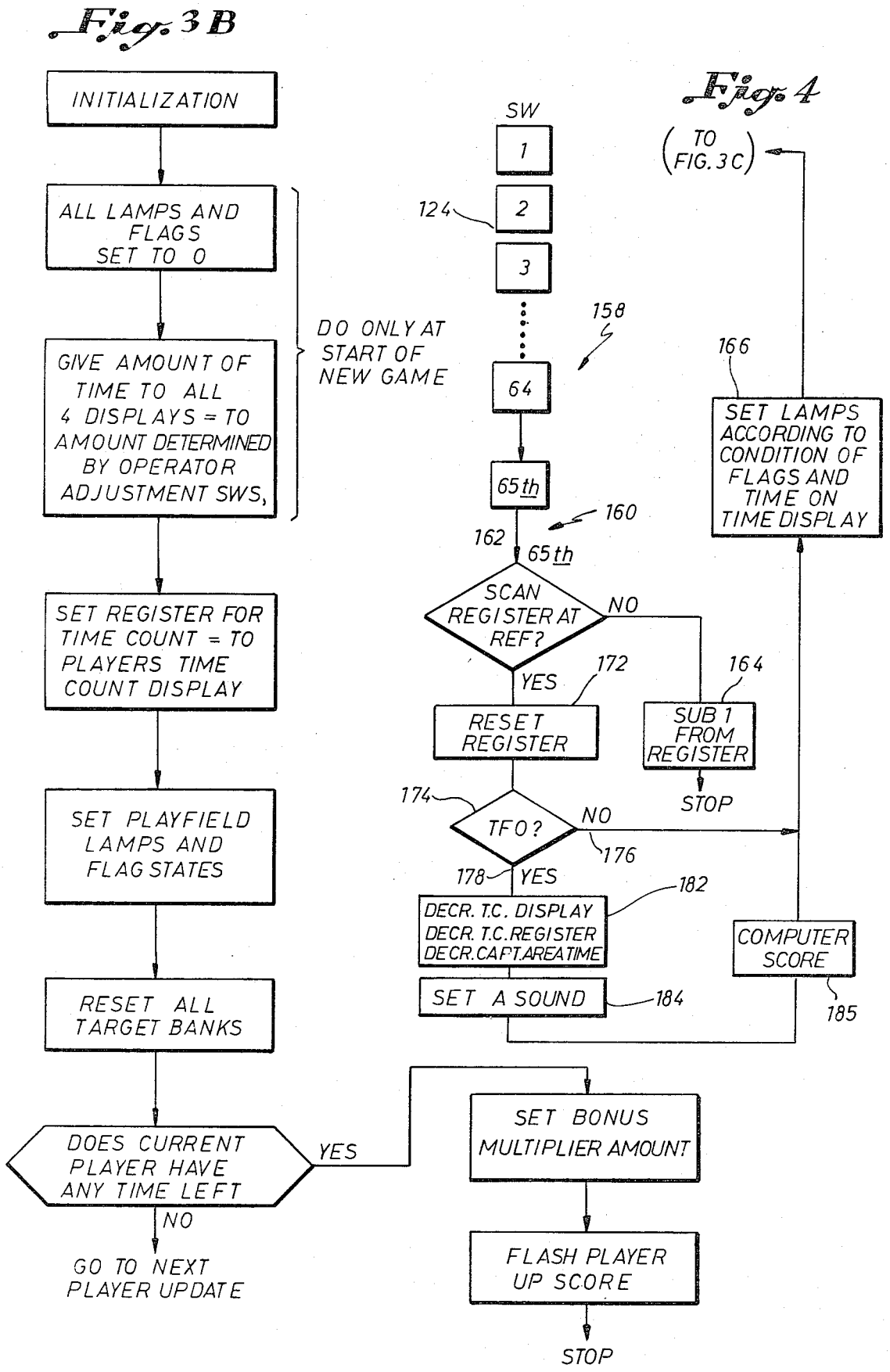
Fig. 3B
INITIALIZATION
ALL LAMPS AND FLAGS SET TO 0
GIVE AMOUNT OF TIME TO ALL 4 DISPLAYS = TO AMOUNT DETERMINED BY OPERATOR ADJUSTMENT SWS,
DO ONLY AT START OF NEW GAME
SET REGISTER FOR TIME COUNT = TO PLAYERS TIME COUNT DISPLAY
SET PLAYFIELD LAMPS AND FLAG STATES
RESET ALL TARGET BANKS
DOES CURRENT PLAYER HAVE ANY TIME LEFT
YES
NO
GO TO NEXT PLAYER UPDATE
SET BONUS MULTIPLIER AMOUNT
FLASH PLAYER UP SCORE
STOP
Fig. 4
SW
1
2
3
64
65th
124
158
160
162
65th
SCAN REGISTER AT REF?
NO
YES
172
164
RESET REGISTER
SUB 1 FROM REGISTER
STOP
174
TFO?
NO
176
178
YES
182
DECR. T.C. DISPLAY
DECR. T.C. REGISTER
DECR. CAPT. AREA TIME
SET A SOUND
184
(TO FIG. 3C)
166
SET LAMPS ACCORDING TO CONDITION OF FLAGS AND TIME ON TIME DISPLAY
COMPUTER SCORE
185

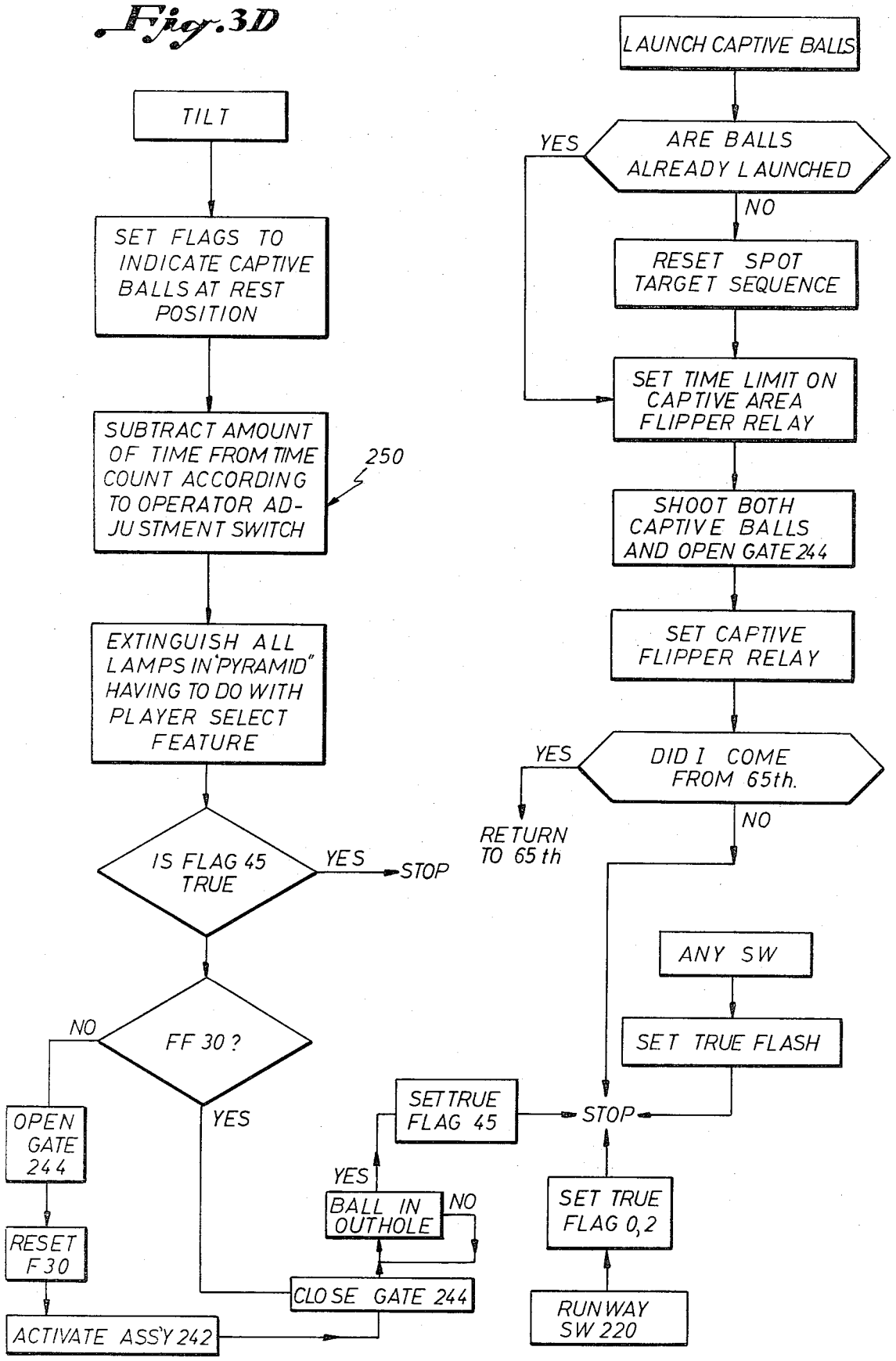
Fig. 3D
TILT
SET FLAGS TO INDICATE CAPTIVE BALLS AT REST POSITION
SUBTRACT AMOUNT OF TIME FROM TIME COUNT ACCORDING TO OPERATOR ADJUSTMENT SWITCH
250
EXTINGUISH ALL LAMPS IN "PYRAMID" HAVING TO DO WITH PLAYER SELECT FEATURE
IS FLAG 45 TRUE
YES
STOP
FF 30 ?
NO
YES
OPEN GATE 244
RESET F30
ACTIVATE ASS'Y 242
CLOSE GATE 244
BALL IN OUTHOLE
YES
NO
SET TRUE FLAG 45
STOP
LAUNCH CAPTIVE BALLS
ARE BALLS ALREADY LAUNCHED
YES
NO
RESET SPOT TARGET SEQUENCE
SET TIME LIMIT ON CAPTIVE AREA FLIPPER RELAY
SHOOT BOTH CAPTIVE BALLS AND OPEN GATE 244
SET CAPTIVE FLIPPER RELAY
DID I COME FROM 65th.
YES
RETURN TO 65th
NO
ANY SW
SET TRUE FLASH
SET TRUE FLAG 0,2
RUNWAY SW 220

TIME BASED PINBALL GAME MACHINE

BACKGROUND OF THE INVENTION

This invention relates generally to flipper-type pinball games of the surface projectile type and more particularly to such pinball games wherein duration of game play is based at least in part on the passage of time.

Traditionally, flipper-type pinball games have been of the type employing a playing field which has a downwardly inclined playing surface and a number of scoring targets and other obstacles disposed thereon. One or more sets of flippers are also disposed on the playing field, and a predetermined number of balls are shot onto the playing field for actuating the scoring targets in response to ball play. During ball play the ball is propelled from scoring target to scoring target in response to forces supplied by the obstacles and by player operation of the flippers. A number of such ball plays has generally defined a game.

There has been an attempt in the past to depart from the traditional flipper-type pinball definition of game play wherein game play is determined by a specified number of ball plays. For example, one flipper-type pinball game is believed to have provided a predetermined amount of play time in which to engage in as many ball plays as possible. For certain playfield scoring achievements, the running of the game play time period appears to have been suspended for a short duration. Time also appears to have been suspended between ball plays when the pinball left the playfield. In this game, the timing element and playfield elements were controlled electromechanically.

With the advent of microprocessor-controller technology, microprocessors soon were utilized as controllers for pinball games. In essence the microprocessor and its peripheral interface components replaced the relay-type electrochemical controller for implementing many of the same functions previously achieved by electromechanical games. Such microprocessor controlled pinball games have contained certain features which were time controlled. For example, some prior art microprocessor pinball games have employed scoring targets which were enabled for operation only during certain time periods. As an example, one target provided a score of a higher value during a predetermined time period, and another target was enabled for operation only during a predetermined time period.

However, the prior art has failed to provide a commercially successful separate type pinball game of the type where game play is determined primarily by time and not by the number of ball plays. It is believed that the shortcomings of the prior art in providing a commercially successful game have been due to lack of game play features such as those hereinafter described and claimed.

SUMMARY OF THE INVENTION

The above noted and other disadvantages and shortcomings of the prior art are overcome by the present invention by providing a new and improved flipper-type pinball game wherein game play is determined primarily by time rather than a specified number of ball plays. The rate at which the duration of game play is expended is variable, including suspension of the running of the period according to achievement of game play objectives. As another feature, a digital processor is provided as a contestant for providing competition with a human player. As yet another feature, audio indicia are generated having sound levels which change during game play to reflect the amount of time remaining in the game play period. As still yet another feature, multiple independent play areas are provided for either concurrent or sequential ball play.

According to one aspect of the invention, a pinball game machine for at least two players has an electronic digital processor for energizing displays to manifest values in response to actuation of scoring targets and in response to bonus signals. Player controlled mechanisms are provided for generating the bonus signals upon selected game play conditions, and the processor is responsive to the bonus signals input by one of the players for changing display values corresponding to another player. The display values which are changed in response to the bonus signals may represent time indicia corresponding to the amount of the game play period remaining.

According to another aspect of the present invention, a pinball game machine is provided of the type in which game play is defined by a succession of ball plays and the duration of game play is determined primarily by time rather than the number of ball plays. In this game machine, a time display is controlled by a processor for generating time indicia having values which change from an initial value at a variable instantaneous rate determined by actuation of scoring targets. The processor includes a mechanism for ending game play according to the value of the time indicia. The variable instantaneous rate may be a zero rate or a positive or negative rate at which values of time are actually added or subtracted from the time indicia.

Further, the processor preferably includes a plurality of operator adjustable switches for setting the initial value of the time indicia according to the preferences of the operator. The player controlled mechanism is preferably a set of button switches which also operate the flippers.

As a feature of the invention, one game play feature which effects the zero rate change condition is operation of a selected flipper mechanism which in turn is activated only in response to achievement of predetermined playfield conditions.

According to another aspect of the present invention, an electronic digital processor controlled pinball game machine is of the type where a human player plays at least in part against the electronic digital processor. A plurality of indicators are operated by the digital processor for manifesting values representing the play status of a given player during his game play and for representing a play status value for the processor. The processor is coupled to yet another indicator for indicating a bonus condition such as a free game or additional game play time for a player when his play status value achieves a predetermined relationship to that of the processor's play status value.

According to another feature of the invention, the pinball game machine has a playfield which has multiple play areas. Structure is provided which confines a plurality of balls respectively to the confined play areas. Each confined play area has its own flipper mechanism, ball and scoring targets. Preferably, the multiple play areas are enabled for ball play concurrently, but in one embodiment ball play in the multiple play areas is sequential.

It is accordingly an object of the present invention to provide a new and improved flipper-type pinball game of the type described.

BRIEF DESCRIPTION OF THE DRAWINGS

The above noted and other objects and advantages of the present invention will become apparent by reference to the following detailed description of a preferred embodiment when read in conjunction with the accompanying drawings, wherein:

FIGS. 3A–3E and 4 are computer flow diagrams for operating a digital processor used in the game having the playfield according to FIG. 2;

DESCRIPTION OF A PREFERRED EMBODIMENT

Figure 1:
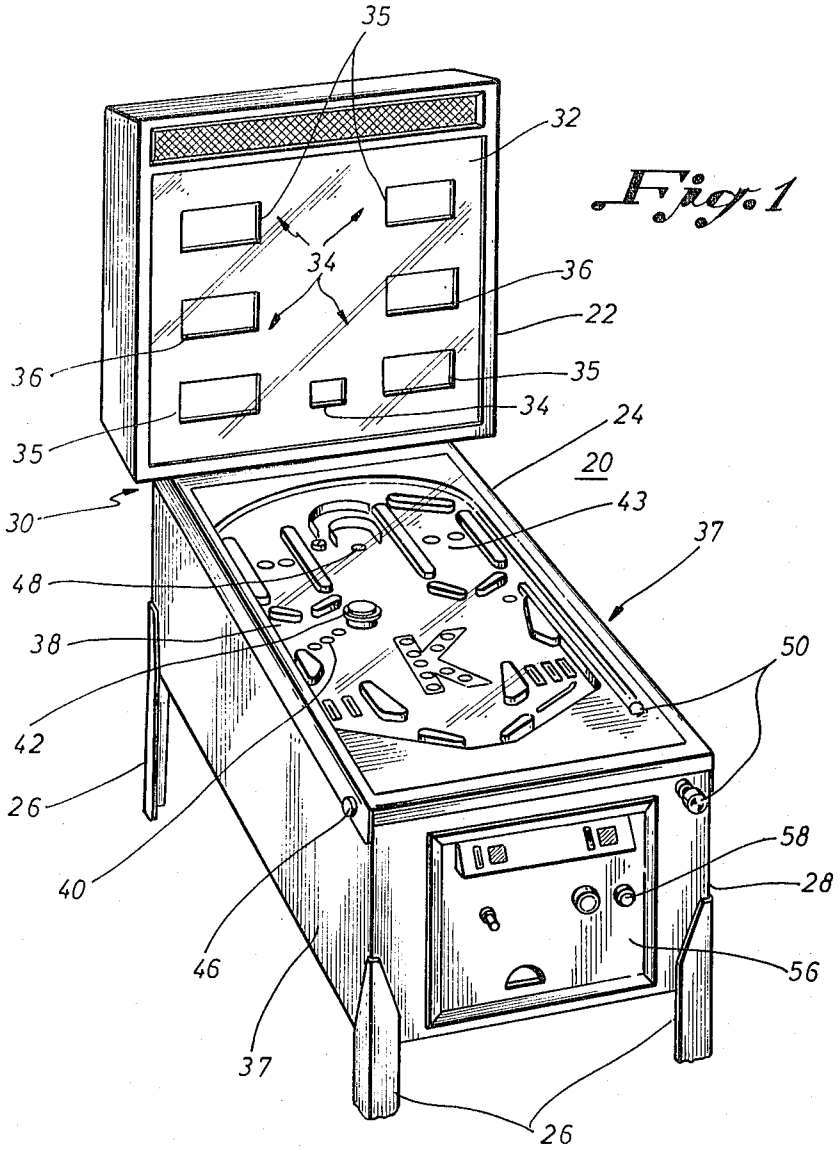
FIG. 1 pictorially represents a flipper-type pinball game of general construction.

The general appearance of a flipper-type pinball game machine 20 constructed and arranged in accordance with the present invention is shown in FIG. 1. The game machine 20 as generally shown in FIG. 1 is conventional, having the usual and expected features common to flipper-type pinball games. For example, the game machine 20 includes an upper cabinet 22 and a lower cabinet 24 which is supported by a set of legs 26 at an elevation comfortable for a human player standing at one end 28. The upper cabinet 22 is supported on the other end 30 of the lower cabinet 24 and extends upwardly to define a front vertical surface 32. A set of displays 34 are disposed in the front surface 32 for manifesting play status of the pinball game machine 20. The displays 34 include a set of scoring displays 35 for manifesting score values of the players and a set of time displays 36 for manifesting time values corresponding to the duration of game play time remaining.

The lower cabinet 24 has a set of sides 37 and a bottom surface which together with the ends 28, 30 define a housing. A playfield surface 38 is movably supported at an incline as the upper surface of the housing. A glass panel is supported overlying the playfield surface 38.

Supported on the playfield surface 38 are scoring targets such as drop targets, roll over switches and swinging wire gates, shown generally at 40, and ball obstacles such as pop bumpers, sling shots, rubbers and posts, shown generally at 42. A set of lamps 43 are provided to be selectively illuminated according to game play. One or more flipper mechanisms 44 are disposed on the playing surface 38, and a set of player operated switches 46 are provided on the sides of the cabinet 24 for electrically controlling operation of the flipper mechanisms 44. One or more balls 48 are provided on the playfield surface 38.

In the end 28 of the lower cabinet, a ball shooter 50 is positioned for shooting the ball 48 in the traditional manner onto the playing field for activating the various scoring targets 40 in response to play operation of the flipper mechanisms 44. In response to actuation of the scoring targets 40 and the obstacles 42, the displays 34 are energized to manifest game play values. As will be explained subsequently, a control mechanism, preferably in the form of a microprocessor computer system, is employed for monitoring ball actuation of the targets 40 and obstacles 42 for energizing the displays 34 during game play.

Also disposed in the end 28 are one or more coin slots 54 which are employed when the pinball game machine is used commercially. The coin slots 54 are in a movable door 56 to allow access to coin detecting mechanisms and a coin depository disposed in the housing. The depositing of a coin in one of the slots 54, or actuation of a game credit switch 58 when additional game plays have been credited, initiates game play.

Anti-cheat mechanisms such as tilt and slam detectors are also provided.

As earlier indicated, the foregoing description is common to general flipper-type pinball and forms the background for the following described invention.

The present invention is directed to a flipper type pinball game where the duration of game play is primarily determined by time and not by a specified number of ball plays. Various novel features according to the invention derive from the concept of employing time as a new dimension in pinball.

Figure 2:
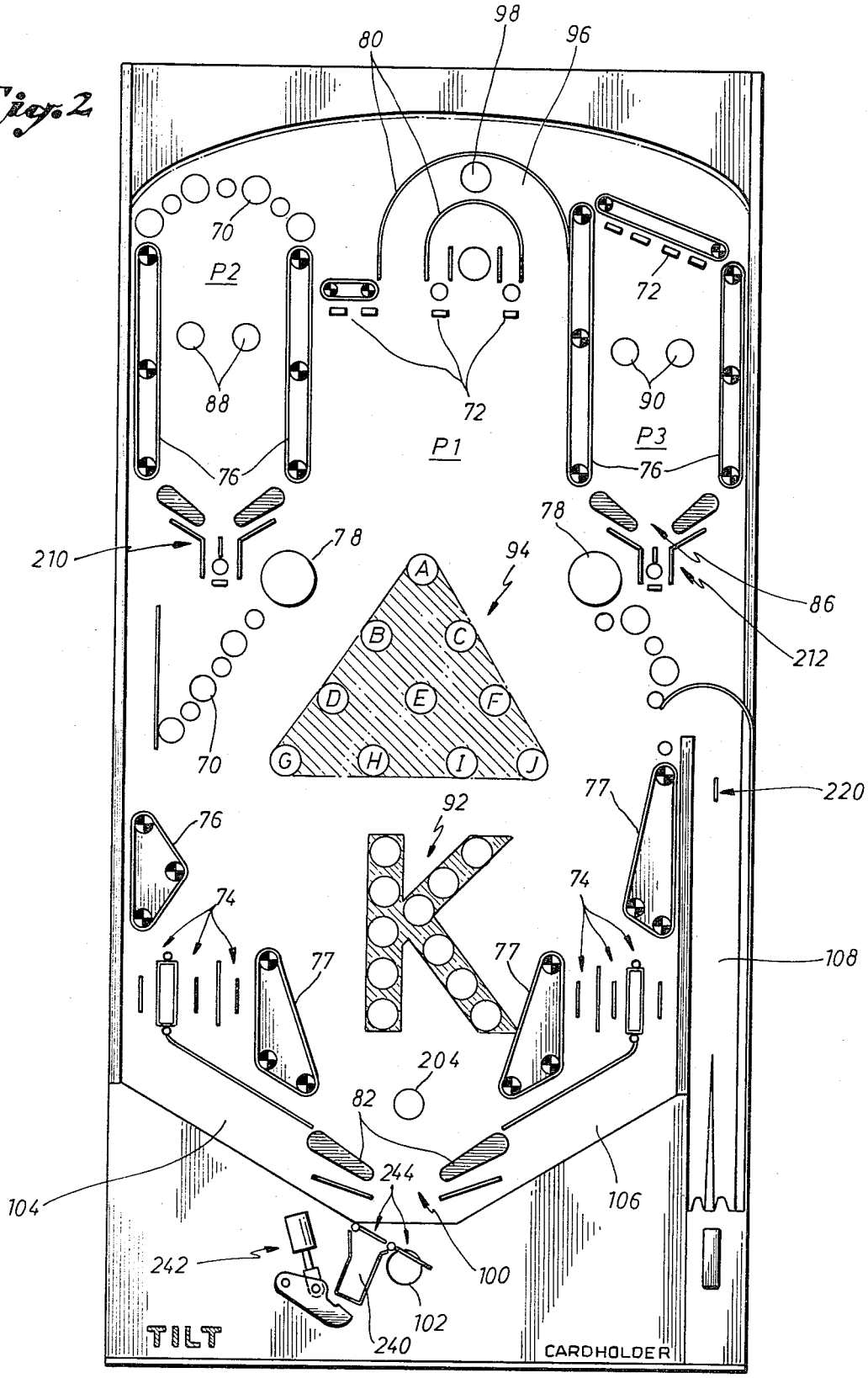
FIG. 2 is a plan view of a playfield and associated apparatus for a flipper-type pinball game according to one aspect of the invention.

Referring now to FIG. 2, a detailed view of a specific playfield surface 38 is shown. The scoring targets 40 include sets of spot or bulls-eye targets 70, sets of drop targets 72, and sets of roll over switches 74. The obstacles 42 include sets of contact rubbers 76 and kicking rubbers 77, sets of pop bumpers 78 and a set of guide wires 80.

The flipper mechanisms 44 include a set of primary flippers 82 and left hand and right hand sets of secondary flippers 84, 86, respectively. The primary flippers 82 and the secondary flippers 84, 86 are all operated by actuation of the player operated switches 46. In particular, the flippers 82, 84, 86 are shown in pairs, with the left flipper of each pair being operated by the left player operated switch 46 and the right flipper of the respective pairs being operated by the right player operated switch 46.

The lamps 43 include left hand and right hand captive area lamps 88, 90, respectively; a set of play achievement lamps 94; and a set of play bonus lamps 92. For the play field of FIG. 2, there are a plurality of balls 48, one for the left hand secondary flippers 84, one for the right hand secondary flippers 86, and one for the primary flippers 82.

The scoring targets 40 and the obstacles 42 define a variety of possible ball paths and corridors during ball play and game play. One such corridor is designated 96 and has defined therein a hole 98 which captures a ball passing through the corridor 96. A kicker mechanism (not shown) is disposed in the hole 98 for releasing the captured ball under control of the control mechanism as subsequently described. Another such corridor is designated 100 and leads to an outhole 102 via a path between the primary flippers 82. A set of side corridors 104, 106 also lead to the outhole 102. A main corridor 108 is defined on the extreme right hand side of the playfield to initially guide the ball after being propelled by the ball shooter 50.

Figures 5, 10A, 10B:
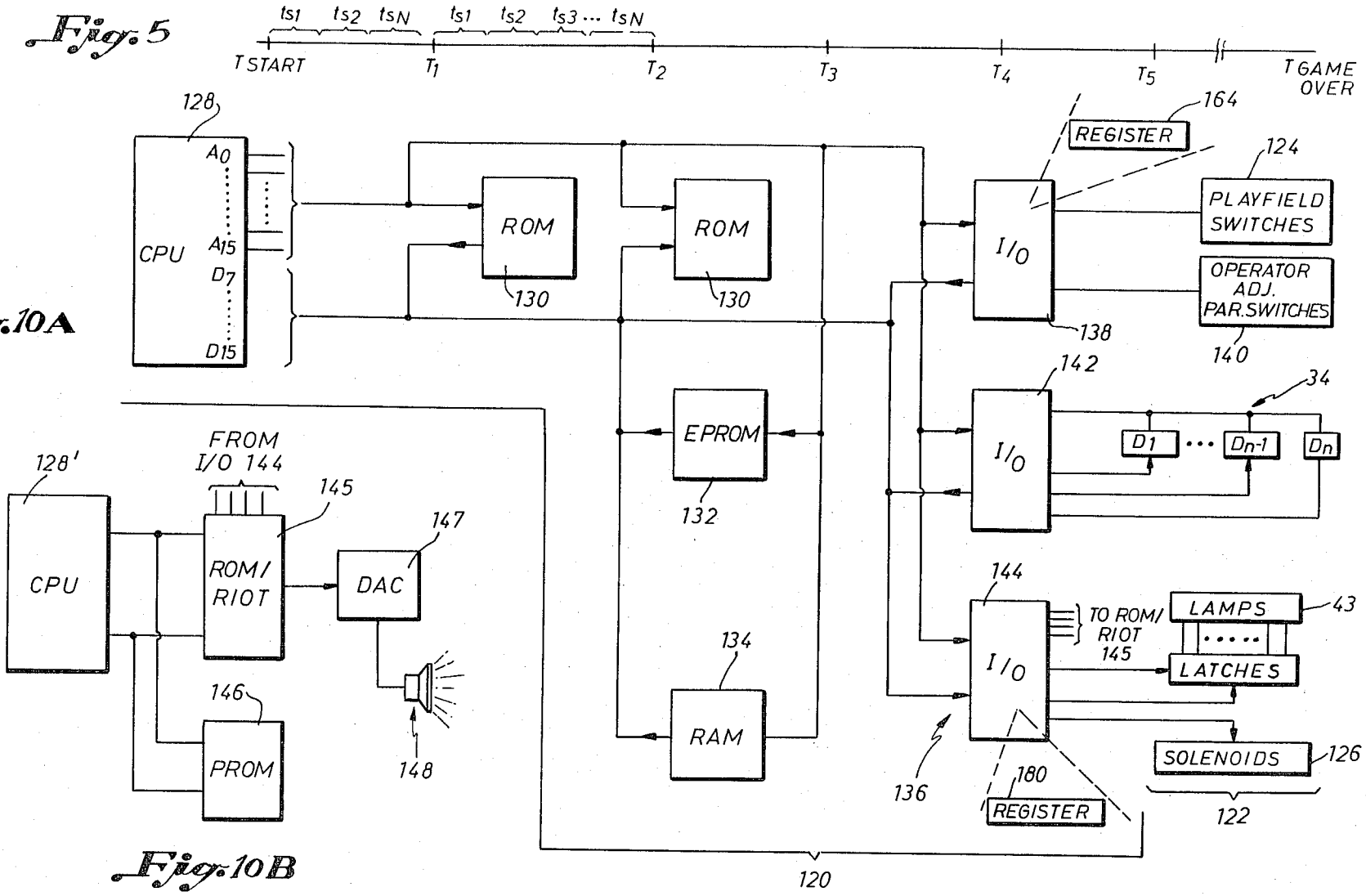
FIG. 5 is a schematic representation of an exemplary game play period.
FIGS. 10A and 10B are circuit schematics showing hardware implementation of the digital processor and associated playfield apparatus.

Referring now to FIGS. 10A and 10B, a digital processor, taking the form of a computer system 120, is shown for controlling operation of the lamps 43 and the displays 34 in response to the operations of the scoring targets 40 and the obstacles 42. It is understood that the processor shown in FIGS. 10A and 10B is shown for purposes of completeness of description only. Other digital processors may be suitably employed according to the invention.

The computer system 120 is shown connected to the various pinball controlled and controlling mechanisms designated at 122. For example, the scoring targets 40 and the obstacles 42 are represented in FIG. 10A as playfield switches 124. The displays 34 and the lamps 43 are shown, and a set of solenoids 126 are shown for driving the usual drop target reset coils, hole kickers and other ball kickers. The pinball pop bumpers 78, kicking rubbers 77 and flipper mechanisms 44 are self-energized.

The computer system 120 includes a central processing unit 128 which may be model R6502 as manufactured by Rockwell International Corp. Connected to the address bus of the CPU 128 are first and second sets of memory chips 130, 132. The memory chips 130 are read-only memory (ROM) chips which may be Rockwell R2332 ROMs. The set of memory chips 132 are erasable programmable read-only memory chips such as model 2716 manufactured by Hitachi Corporation. The memory chips 130, 132 store the software implementation of the various software routines shown in FIGS. 3, 4, 7 and 9 hereof. A third memory chip 134 is a random-access memory (RAM) which may be model 5101 as manufactured by Intel Corp. The RAM 134 is utilized for bookkeeping purposes such as storing the number of games awarded, the number of coins taken in, high score to date, etc.

Also connected to the address lines of the CPU 128 are input/output devices 136. The devices 136 as illustrated are model R6532 devices manufactured by Rockwell and provide random-access memory, input/output and timing (RIOT) functions. The RIOT devices 136 have ports which are programmable to be either input ports or output ports. The preferred and illustrated embodiment of FIG. 10 shows one of the RIOT devices 138 connected to scan the playfield switches 124 via an eight-bit output port while the other eight-bit port of the RIOT 138 is programmed as an input to receive information from a set of operator adjustment parameter switches 140 and to receive the information from the playfield switches 124. The second RIOT device 142 has its ports connected as output ports for driving the displays 34. The third RIOT device 144 has its ports programmed as output ports for driving the lamps 43 and the solenoids 126. Conventional biasing and level shifting circuitry is not shown.

As shown in FIG. 10A, the RIOT device 138 defines a scan register 164, and the RIOT device 144 defines a time register 180. The time register 180 contains the value depicted on the time display 36 for a given player, and, as will be explained, the scan register determines the rate at which the value of the time register is caused to change.

FIG. 10B shows generally the sound generating system for the pinball game machine 20. A second CPU 128′ is coupled to an input/output device, such as a ROM-RIOT device 145 such as a Rockwell R6530 and to a memory device such as a PROM 146. A digital to analog converter 147 is controlled by the CPU 128′ via the ROM-RIOT 145 for operating a speaker and amplifier assembly 148. The speaker 148 is driven to emit any of a variety of sounds as hereafter explained.

Referring again to FIG. 2, operation of the pinball game machine having the playfield depicted therein will now be described in terms of the software shown in FIGS. 3A–3E and FIG. 4.

Figure 3A:
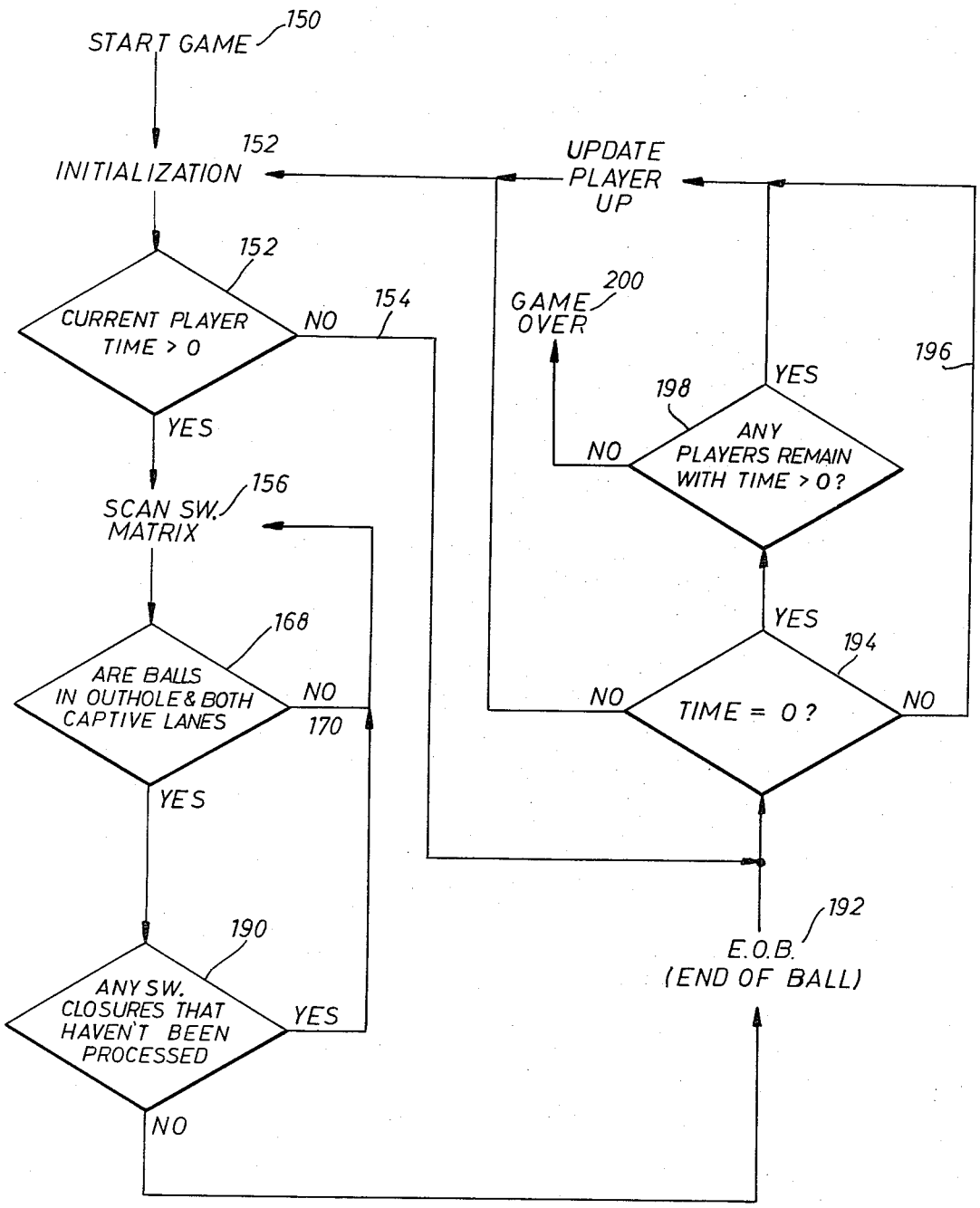

After a coin is inserted into the coil slot 54 and after the credit button 58 is actuated to start the game as indicated at step 150 in FIG. 3A, the computer system 120 undergoes initialization at step 152. Initialization includes adjustment of the number of credits in response to coin insertion at the start of the game and adjustment of the number of credits when the game start button is actuated to commenced game play. Initialization also adjusts the values on the various displays 34, including adjusting the value of the time display 36 to the initial value corresponding to the maximum allowed play period. Initialization also includes scanning of operator adjustable switches as will be subsequently explained. Initialization also includes other standard routines such as bookkeeping routines. The computer flow diagram for initialization is set forth in FIG. 3B.

After initialization and the computer has been instructed as to the number of players, the computer checks at step 152 to see whether the current player has any game play time remaining. If not, the current player does not receive an additional ball play, and game play passes to the next player as shown at step 154.

If the current player has time remaining, the computer begins scanning the playfield switches 124 as shown at step 156. The switch matrix scanning step 156 is shown in more detail in FIG. 4 and serves to provide the computer system 120 with game play information according to ball actuation of the scoring targets 40 and obstacles 42 on the playfield 38.

Referring now to FIG. 4, the playfield switches 124 are schematically represented as being scanned by the computer via conventional multiplexing techniques. FIG. 4 depicts 64 playfield switches. According to the preferred software embodiment, a single pass through the 64 switches is made by the computer. If actuation of a given switch is detected, the switch actuation is processed via the appropriate subroutine, for example, to light the lamps 43 and update the score displays 35. This is indicated at step 158 in FIG. 4.

Upon completion of the scanning and processing of the playfield switches 124, the computer system 120 checks the value of a memory location in software. This memory location is referred to as the 65th switch which is treated by the computer as if it were one of the playfield switches 124. However, the 65th switch provides the capability for introducing novel features into pinball game machines for creating increased player appeal.

The routine shown in FIG. 4 at step 162 concerning the 65th switch is employed as one way to implement the outstanding feature of decreasing the game play time interval of a given player at an instantaneous rate which is determined in part by playfield activity. Specifically, as a feature of the present invention, the remaining period of game play for a given player, while reducing at a constant rate for no playfield activity, decrements at a decreased rate as the playfield activity increases. In this way, the player's skill at rapid and multiple scoring is advantageous because it increases the overall time of game play by reducing the rate at which his game play period decrements.

When the computer system 120 checks the 65th switch location, it is directed to a register location to check a scan value. This register location is shown in FIG. 10A as part of the random access memory in the RIOT 138 and is depicted as the register 164.

During the initialization step 152, maximum time and scan register values are input to the computer system 120 via setting of the operator adjustable parameter switches 140. As seen in FIG. 4, the computer system 120 after control is transferred from the 65th switch, checks to see whether the scan value stored in the scan register 164 is at the reference scan value, which is zero in the preferred and illustrated embodiment. If the scan register is not at the value, the scan register value is changed by one, which in the preferred embodiment, is a reference subtraction, as shown at step 164. After completion of the routine, the computer system 120 is free to proceed (FIG. 3A) with the next step in the flow diagram as indicated at step 168.

If ball play is not over, i.e., if the ball 48 has not dropped into the outhole 102, the computer system 120 knows the ball play for a given player is continuing and that it must rescan the switch matrix. This is shown at step 170 in FIG. 3A and the above-described process with respect to FIG. 4 is repeated.

If the next pass through the playfield switches 124 to the 65th switch location results in the scan register 164 having the reference scan value, then the scan register 164 is reset as shown at step 172 and a Flag 0 location is checked as shown at step 174.

Flag 0 location contains a value indicative of whether Flag 0 is in a zero or one state. The setting of Flag 0 is determined according to actual playfield conditions. If the player has not achieved the playfield condition necessary to set Flag 0 in the true state as shown at step 176, the computer goes to step 166. If however, the playfield conditions have been met, Flag 0 is set into the true condition and the computer system proceeds as shown at step 178.

As indicated above, Flag 0 is set according to the particular playfield structure and game play rules. According to the playfield of FIG. 2, Flag 0 is set in the true state when rollover switch 220 has been actuated. It may be reset on rate occurrences comparable to bonus conditions. That is, a player's time register 180 is caused to decrement unless the player can achieve certain playfield bonus conditions. In game play according to the playfield of FIG. 2, the special bonus conditions to reset Flag 0 to the zero state could be programmed to occur, for example, upon successfully dropping all of the drop targets 72. Then Flag 0 can be set upon ball engagement with a particular roll over switch 74 or spot target 70.

As seen in FIG. 10A, the RIOT 144 contains in its random-access memory location a time register 180. The time register 180 is operated to contain a time value which is displayed on the time display 36.

Referring again to FIG. 4, if Flag 0 has been set in the true condition, the computer system decrements the time register 180 and decrements the time display 36. This is shown at step 182. The computer then determines a particular sound to be emitted, as shown at step 184 and the computer then returns to the step 166.

The step of setting the sound at step 184 is a feature of the invention which allows a different sound to be generated according to the particular value in the time register 180. For example, one sound is generated upon commencement of the game when the time register 180, and thus the time display 36, is at its maximum value. On the other hand, when play time has nearly expired and the time register 180 contains a low value, an alarm type sound is emitted to warn the player that he is dangerously close to the end of game play.

From the foregoing it will be appreciated that decrementing of the time register 180 is a function of the number of occurrences that the computer checks the 65th register location at step 160. This occurrence is in turn a function of the number of actuations of the playfield switches 124 as shown at step 156. Accordingly, the player is to some extent in control of the instantaneous rate of decrement of his time register 180 and thus his time display 36. Thus, the higher the reference scan value placed within the scan register 164, the slower the decrementing of the time register 180, and conversely. Similarly, the more that a player can engage the scoring targets 40 and the obstacles 42, the longer it will take the computer system 120 to reach the 65th switch, thereby giving the player some control over the rate at which the scan register 164 decrements. This is a feature of the invention which is attractive and promotes player appeal.

FIG. 5 illustrates a typical example illustrating decrementing of the scan register 164. At Tstart the scan register is at an initial value. During periods $t_s$ the computer system 120 is scanning the playfield switches 124. This process repeats several times, $t_{s1} \ldots t_{sn}$, until at time $T_1$ processing of the 65th switch indicates that the scan register has reached the reference value and the time register 180 should be decremented. As illustrated in FIG. 5, the different scan periods Tstart-$T_1$; $T_1$-$T_2$; etc. are of varying durations, illustrating differences in the length of time required to reach the 65th switch due to differing player actuation of the scoring targets 40 and the obstacles 42. The duration between times $T_1$, $T_2$ etc. thus vary until T game over is reached, corresponding to expiration of the player's game play time.

According to another feature of the invention game play need not terminate upon expiration of the game play period as manifested by the time register 180. As shown in FIG. 3A, a preferred embodiment having increased player appeal causes the end of game play upon the joint condition of no time left in the time register 180 and achievement of a predetermined playfield condition. This condition, for example, is the occurrence of both captive balls (respectively associated with the secondary flippers 84, 86) and the ball associated with the primary flippers 82 coming to rest in their respective outholes. This is shown in FIG. 3A at step 168, whereby once the switch matrix scanning procedure has commenced (as at step 156) due to a player's time being greater than zero, the switch matrix scanning continues, (i.e., game play continues,) until all the balls are in the respective outholes even though the current player's gameplay time may reach zero.

After a player's game-play time is zero, and after all balls are in the respective outholes, the computer system 120 then checks (as at step 190) to see whether any switch closures had been detected that had not been processed. Completion of such processing defines end of ball play, as shown at step 192.

For multiplayer pinball games, wherein the several players take turns after each ball play, the computer system 120 checks at the end of a ball play for a given player to see whether the current player has any time in his time register remaining, as at step 194. If the current player has game-play time remaining, the above sequence repeats as shown at step 196. If the current player does not, then the computer system 120 steps to the next player to see if he or the remaining players have time remaining, as at step 198. When no players have time remaining, game play is over as indicated at step 200.

Referring to FIG. 2, another of the outstanding features of the present invention is the provision allowing one player to directly alter the game status condition of another player. Upon achieving each of various achievements, the computer system 120 records that achievement in memory and lights a particular one of the set of play achievement lamps 94 which is a set of the playfield lamps 43.

For example, as seen in FIG. 2 the play achievement lamps 94 are arranged in a pyramid with lamp designations A through J. Each of the lamps A through J correspond to a special alteration allowed to the current player because of his corresponding achievement. For example, in the preferred and illustrated embodiment, lamp A of the play achievement lamps 94 corresponds to lighting a special light; light B corresponds to adding time to one of the player's time register 180; lamp C stands for subtracting time; lamp D corresponds to adding score to another player'S score displays 35; lamp E corresponds to tilting another player's ball-play; and lamp F corresponds to subtracting score from a selected player's scoring display 35. In the illustrated embodiment, the amount of time added or subtracted is equal to the number of lights lit on the play bonus lamps 92. The score added or subtracted is 10,000 times the number of lit play bonus lamps 92. It is to be understood that the selection of playfield accomplishments which enable each of the given alterations and the value and scoring awarded for those accomplishments are merely a matter of game design.

Lights G-J in the play achievement lamps 94 correspond to players 1 through 4 respectively. As will be explained later, another feature of the invention is that one of the four players may be the computer system 120 itself.

A selector lamp 204 is provided as another of the playfield lamps 43. The selector lamp 204 is energized by the computer system 120 whenever it is time to indicate to the player that he can dispense his special alterations. For example, if at the end of a ball play a given player has special alterations shown in the play achievement lamps 94, the selector lamp 204 will begin to flash. One of the play achievement lamps 94 corresponding to the special alteration will also be flashing and one of the lamps designated G-J corresponding to given players will be energized. Only one of the player indicating lamps G-J is energized at a single time, and the particular lamp which is energized is selected according to a player control mechanism. In the preferred and illustrated embodiment, one of the flipper mechanisms 44 controls the selection of the particular one of the lights G-J. Specifically, when the selector lamp 204 is flashing, each actuation of the left most flipper 82 energizes the next in sequence lamp of the lights G-J. For example, if light G is lit when the selector lamp 204 is flashing, the next actuation of the left most flipper switch 46 advances the energized light to the H light. After the G-J light is lit corresponding to the player to whom the current player wishes to address his special alteration, then the current player actuates another player controlled mechanism to enter the special alteration data into the computer system 120. In the preferred and illustrated embodiment, this mechanism is the right most of the primary flippers 82, and the player energizes the right most player operator switch 46. This procedure is set forth in the figures in FIG. 3E.

Yet another outstanding feature of the invention is the provision which allows the computer system 120 to effectively be one of the players in a multi-player pinball game. In the preferred and illustrated embodiment the computer is accorded a changing score, and the human player is awarded free games and/or extra ball play or time if he exceeds the score of the computer. Further, if the score of the computer exceeds the score posted for the human player to beat for his free game award, then the human player also is awarded the free games/time/extra balls won by the computer.

In more detail, the score of the computer is determined by the scoring activity of the human player. Referring to FIG. 4 at step 185, the value of the computer score is calculated in the sequence shown in FIG. 4 and as follows. At the appropriate play conditions, a computer score value is added to the computer score depending upon how many human players are in the game. If there is one human player, a relatively large score such as 9000 is added. If there are two human players, an intermediate high score is added such as 5000. If there are three players, an intermediate low value is added such as 4000. If there are four human players, then either a zero value or low value is added to the computer score, depending upon how many player game the machine is designed to be. For example, in the preferred and illustrated embodiment, the pinball game machine 20 is designed to be a four player game. For this configuration a zero value score would be added to the computer score since the computer would in that case be a fifth player (and the machine is only set up to be a four player game.)

The reference play conditions when the computer score is added during the 65th switch routine are that the captive balls must be at rest in the playfields P2, P3 and the current player's time must be greater than zero.

According to another outstanding feature of the invention, and as shown in FIG. 2, the overall playfield is actually a composite of three distinct, independent playfields, P1, P2, P3, each having its own unique ball 48. The P2 playfield is the playfield defined by the spot targets 70, the contact rubbers 76, and the lefthand secondary flippers 84. The P3 playfield is defined by the drop targets 72, the contact rubbers 76, and the righthand secondary flippers 86. Each of the playfields P2, P3 also respectively include a switch and kicker assembly 210, 212 disposed between the respective secondary flippers. The respective switch and kicker assemblies maintain the respective balls in the respective playfields P2, P3 such that each of the playfields P2, P3 is self-contained. That is, the ball associated with the P2 playfield is captive therein and the ball associated with the P3 playfield is captive therein.

The P1 playfield is of more conventional organization, and is the one associated with the primary flippers 82. Thus, the captive playfields P2, P3 are physically disposed on and within the P1 playfield.

Figure 3C:
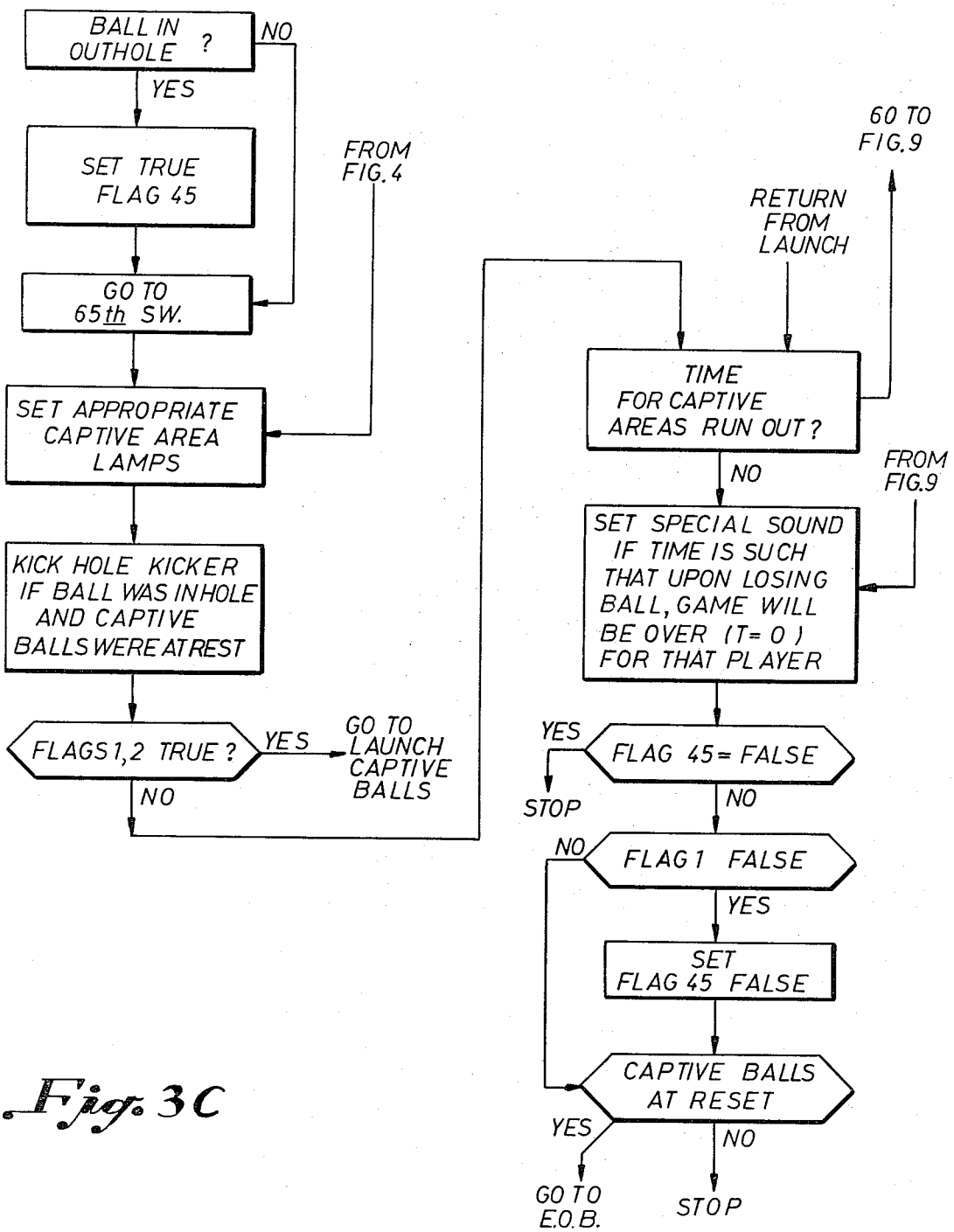

In operation and as shown in the flow diagrams of FIG. 3C, in the preferred and illustrated embodiment the captive balls in the P2, P3 playfields are launched whenever the main P1 playfield ball is shot from the main corridor 108 onto the main playfield P1, thereby passing over a main corridor switch 220. The respective switch and kicker assemblies 210, 212 are energized by the computer system 120 to launch the respective balls into the captive playfields P2, P3. In the interim, the main playfield ball is also in play on the P1 playfield.

According to the preferred and illustrated embodiment, the captive playfields P2, P3 are enabled for play only for a predetermined length of time. At the end of the predetermined length of time, the computer system 120 deactivates the secondary flippers 84, 86. These playfields are thereafter inactive and play is confined to the P1 playfield until either the switch 220 is once again activated or until other playfield conditions are detected by the computer system 120. Thereupon ball play is again enabled in the captive playfields P2, P3.

As a feature of the invention, provision is made in the P1 playfield to suspend operation of the main ball 48 and to launch the captive area balls so that the player can concentrate on achieving the highest score in the captive playfields P2, P3. To this end, the hole 98 in the corridor 96 is provided to temporarily capture the ball upon a skilled shot by the player. At the end of the play in the captive playfields P2, P3, a kicker mechanism (not shown) in hole 98 is energized by the computer system 120 to re-launch the main ball back into play on the P1 playfield.

Other variations of the captive playfield theme are suitably within the invention. For example, the computer system 120 may be programmed to enable operation of the captive play areas P2, P3 in succession rather than concurrently. Further, the duration of play enablement in the captive play areas P2, P3 can be selectively extended by game play in the respective areas. For example, knocking down all of the drop targets 72 could extend play in the P3 playfield. Similarly completing all of the spot targets 70 in the P2 playfield could extend play there. In the preferred embodiment, all like spot targets 70 are electrically connected in parallel.

Figure 6:
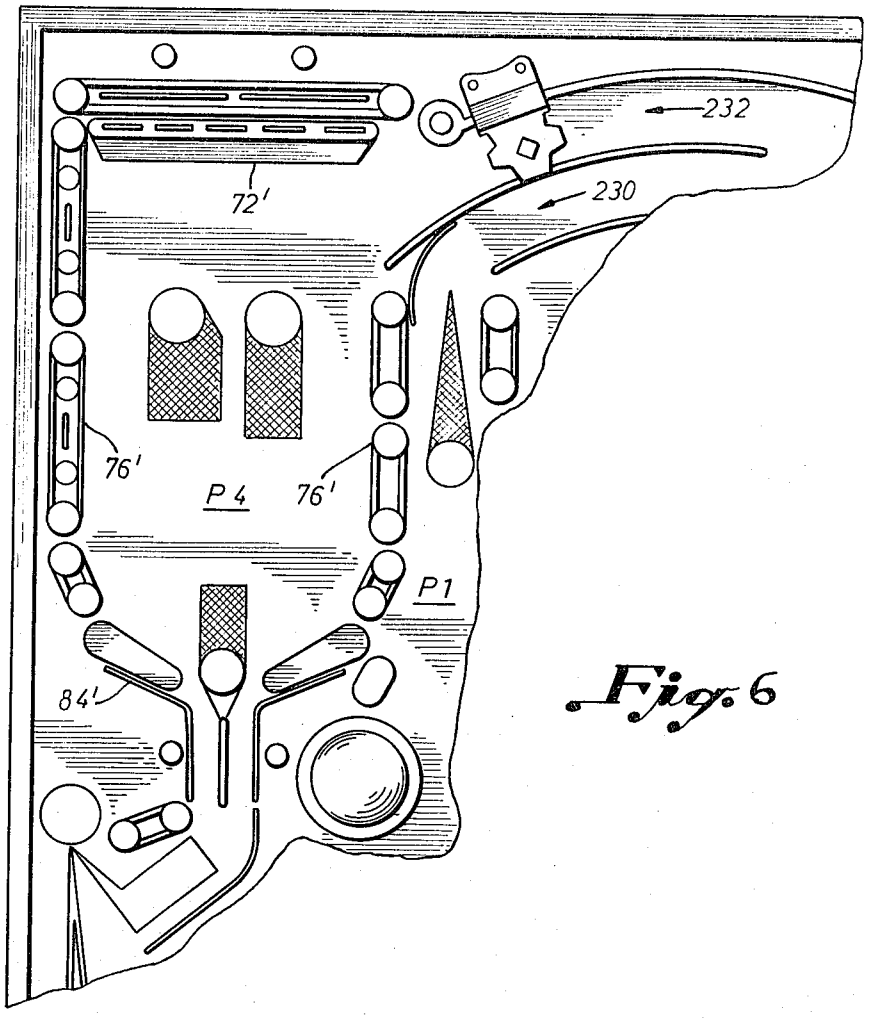
FIG. 6 is a partial playfield schematic according to yet another aspect of the invention.
Figure 7:
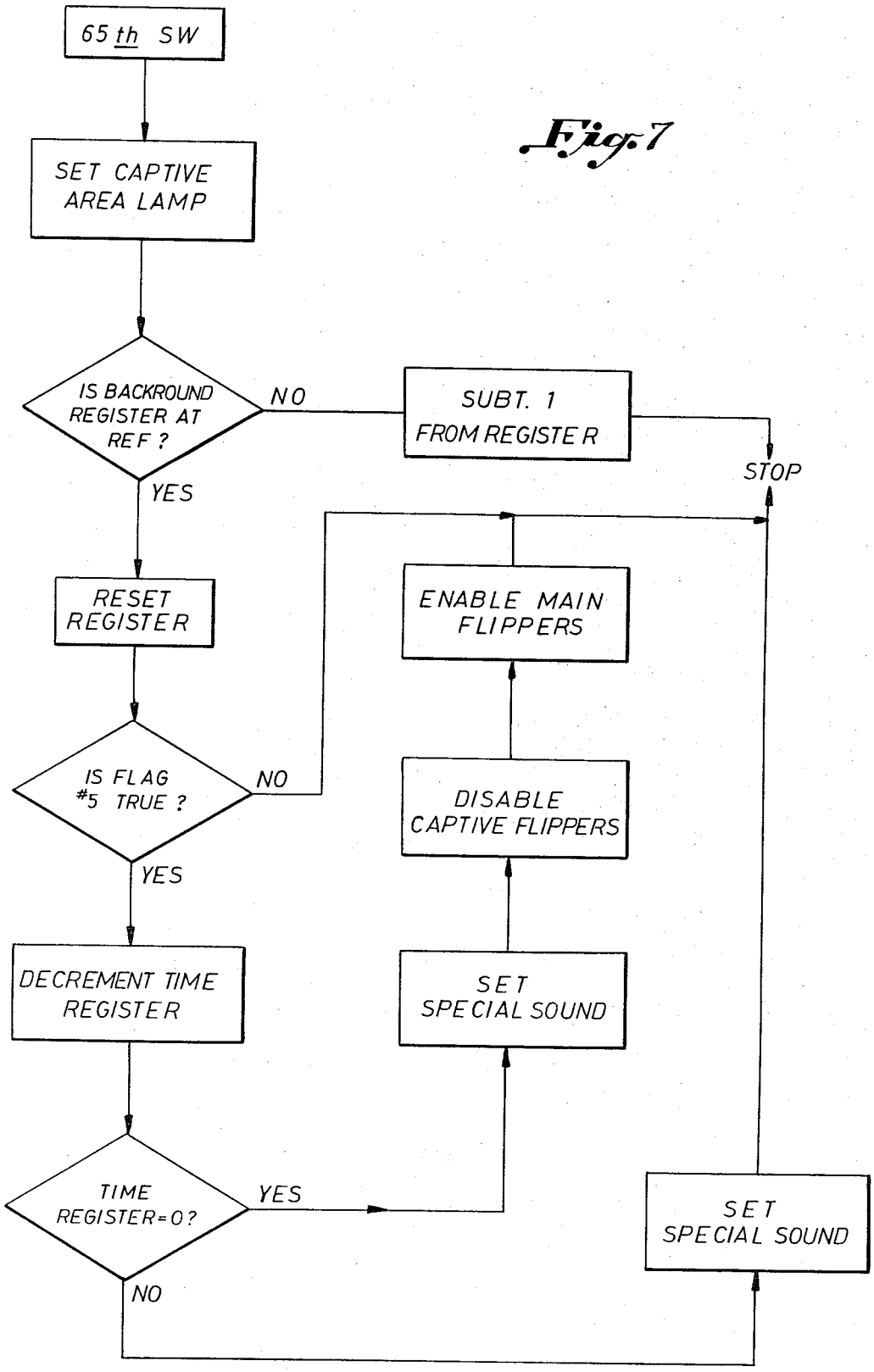
FIG. 7 is a computer flow diagram for operating the digital processor according to the playfield of FIG. 6.

Yet other variations are within the scope of the present invention. Referring to FIGS. 6 and 7, a secondary playfield P4 is shown which, contrary to the captive playfields P2, P3, is not a captive playfield. Rather, the main playfield ball may go into a primary corridor 230 or into a secondary corridor 232. If the ball goes into the primary corridor 230, it bypasses the secondary playfield P4, and ball play is on the P1 playfield.

However, if the ball enters the secondary corridor 232 it enters the secondary playfield P4 for ball play.

Similar to the play of secondary playfields P2, P3, in the preferred and illustrated embodiment of FIGS. 6 and 7, ball play in the P4 playfield is also for a predetermined maximum period of time. At the end of the predetermined period of time, the computer disables the secondary flippers 84' to cause the ball to roll into the P1 playfield.

However, since the P4 playfield is not a captive playfield and there is no device corresponding to the switch and kicker assembly 210 in the P2 playfield, the ball during play on the P4 playfield may be lost when it passes between the auxiliary flippers 84' at which time ball play on the P1 playfield resumes. The flow diagram for this operation is set forth in FIG. 7.

Figure 8:
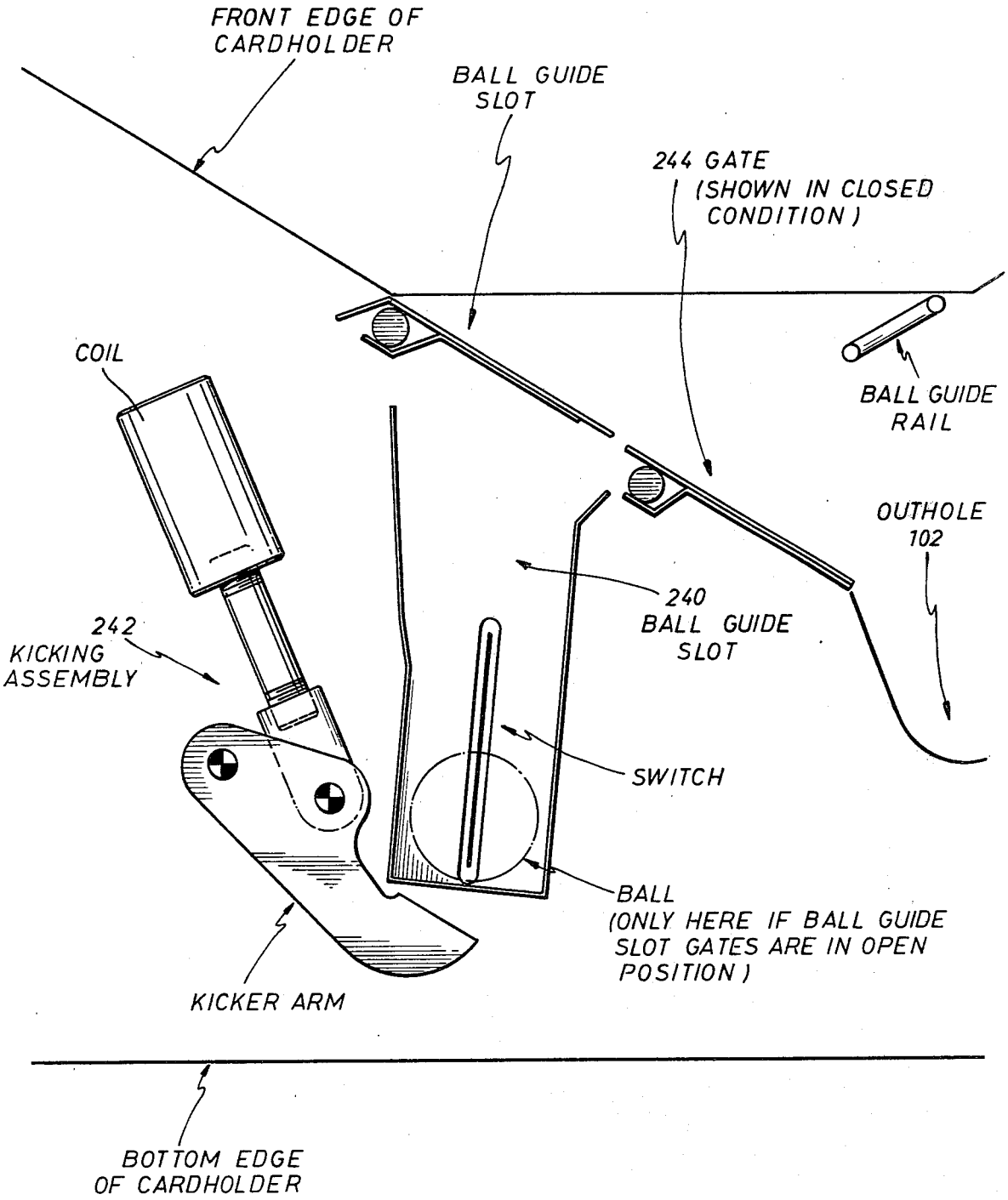
FIG. 8 is a partial playfield schematic according to yet another aspect of the invention.
Figure 9:
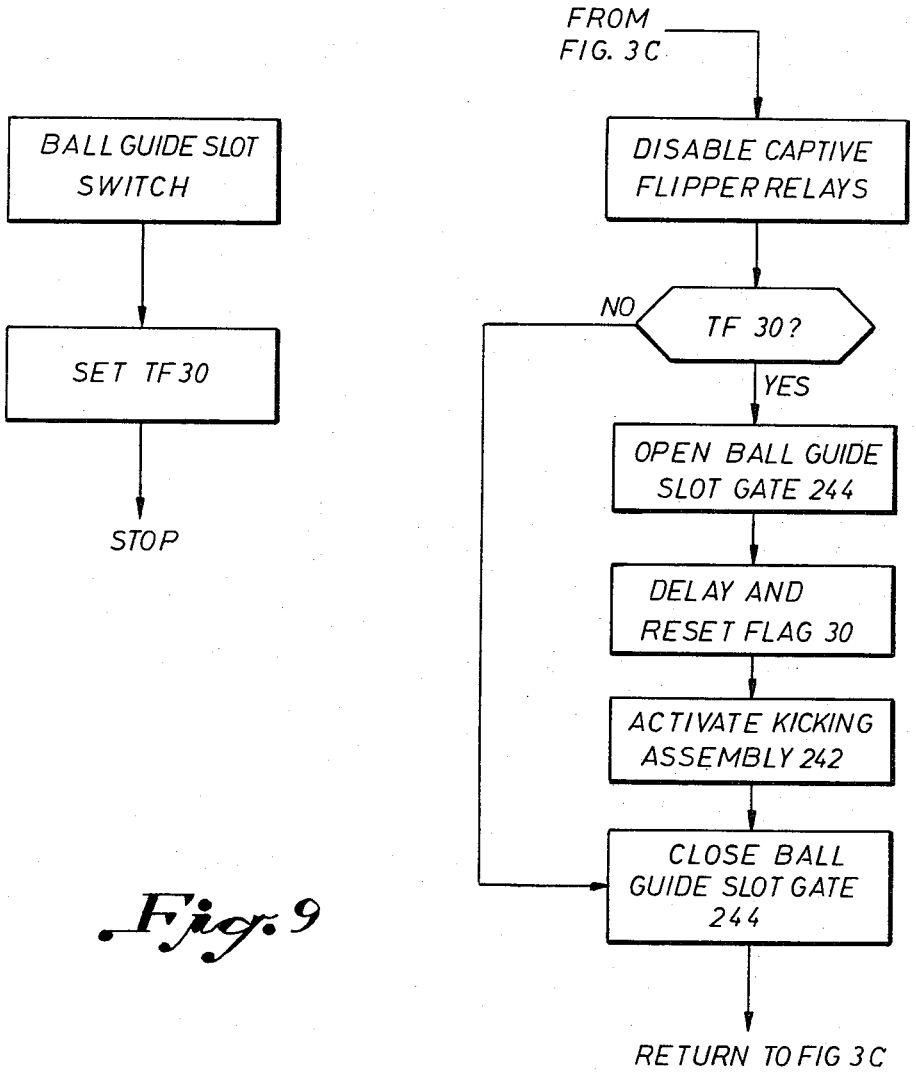
FIG. 9 is a computer flow diagram for the digital processor according to the partial playfield of FIG. 8.

Yet another variation of the present invention is shown in the partial playfield layout of FIG. 8 and in the flow diagram corresponding thereto in FIG. 9. FIG. 8 is a modification to the playfield of FIG. 2 wherein a ball guide slot 240 and kicking assembly 242 are provided in addition to the outhole 102. The main computer system 120 controls operation of a ball guide slot gate 244 to effectively suspend ball play on the main P1 playfield during play in captive playfield areas such as play areas P2, P3 in FIG. 2. Thus, even if the player is not sufficiently skilled to lodge the ball in the hole 98 in FIG. 2 during ball play in the captive play areas P2, P3, he will not lose his main ball on the P1 playfield if it should pass between the primary flippers 82 or out the side lines 104, 106.

Figure 3E:
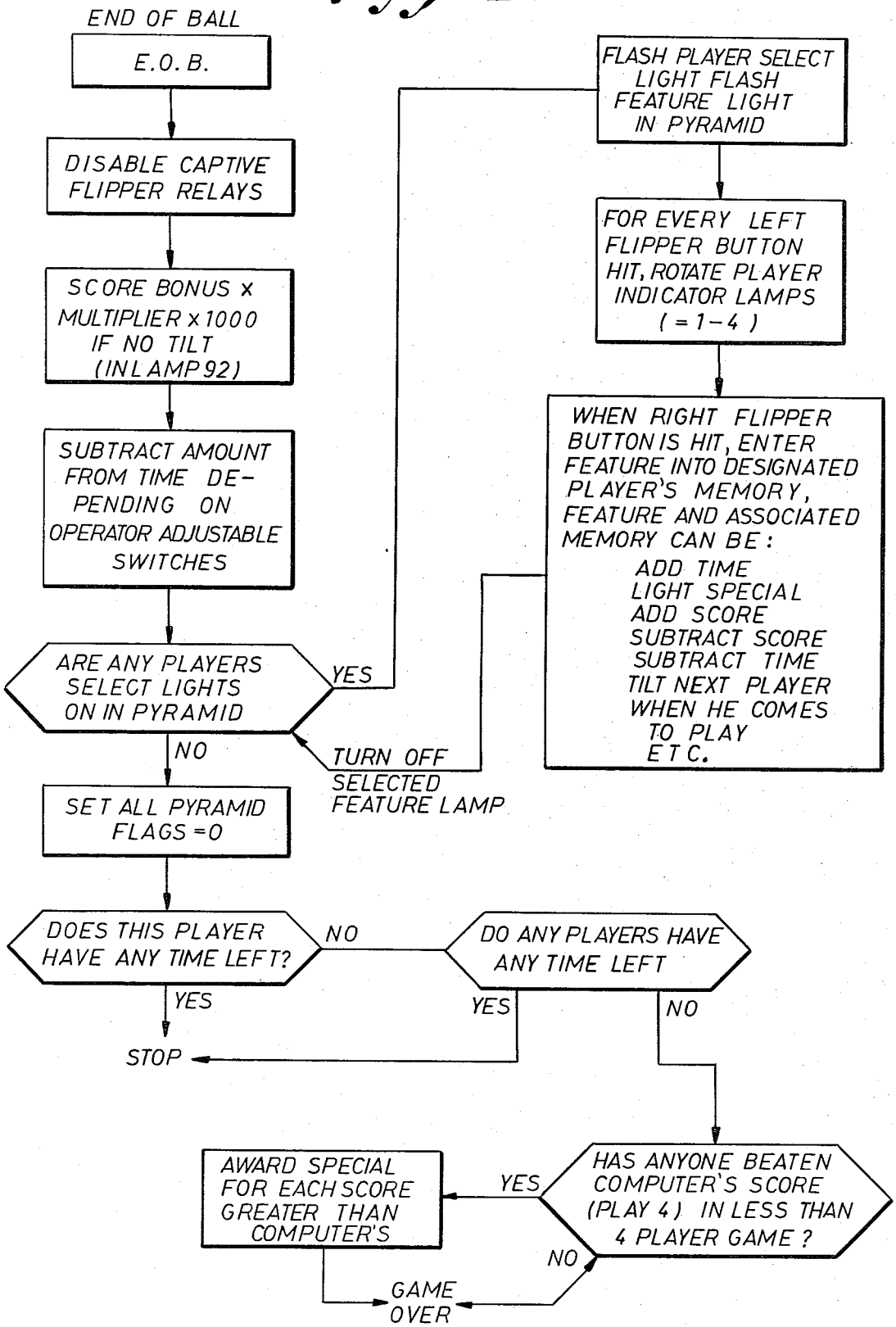

In the preferred and illustrated embodiment, upon the end of each ball play, i.e. upon the main ball falling in the outhole 102, the computer system 120 penalizes the player by subtracting a value from the time register 180. This value is programmable and input to the computer 120 via the operator adjustable switches 140. This process is shown in FIG. 3E.

In the above-described variations of ball play, the computer system 120 can be programmed to end ball play merely upon expiration of the ball play period, regardless of playfield status at the time. However, it is believed to be a more attractive feature for the player if the computer system 120 is programmed to define end of ball play upon the occurrence of both expiration of the ball play period and all balls in their respective outholes or respective play-over positions.

Referring now to FIG. 3D, a flow diagram for effecting the TILT condition is set forth for the time based game. As shown at step 250, time value is subtracted from the time register 180 upon the TILT condition. The value may be a slight penalty value corresponding to loss of a ball play (i.e. a small penalty value corresponding to the ball 48 dropping into the outhole 102) or it may be a large penalty value corresponding to loss of game play. In this case the value would be large enough to assure the time register value reaching zero. This value is programmed into the computer via the operator adjustable switches 140.

Although the invention has been described in its preferred form with a certain degree of particularity, it is understood that the present disclosure has been made only by way of example. Numerous changes in the details and construction of the combination and arrangement of the apparatus described herein will be apparent without departing from the spirit and scope of the invention.

What is claimed is:

1. An electronic digital processor controlled pinball game machine for at least two players, comprising:

(a) a playfield having scoring targets thereon;

(b) a ball for moving on the playfield and engaging and actuating the scoring targets thereby defining ball play, a succession of ball plays defining a game play;

(c) a plurality of displays for indicating values representing game play status of the two players;

(d) an electronic digital processor for energizing said displays to manifest said values in response to the actuation of said scoring targets and in response to bonus signals;

(e) player controlled means actuable at the end of a given ball play for generating said bonus signals upon achievement of selected game play conditions during previous ball play said digital processor including means for detecting said achievement of selected game play conditions and enabeling operation of said player control means; and (f) said processor being responsive to said bonus signals input by one of said players for changing the display values corresponding to another of said players.

2. The pinball game machine according to claim 1 wherein said display value changed in response to said bonus signals is a scoring value.

3. The pinball game machine according to claim 1 wherein said display value changed in response to said bonus signals is a time value.

4. A pinball game machine in which the game play is defined by a succession of ball plays and the duration of game play is determined by time rather than the number of ball plays, comprising:

(a) a playfield, scoring targets thereon, and scoring indicators associated therewith for indicating scoring values according to actuation of said scoring targets;

(b) a ball for moving on the playfield and engaging and actuating the scoring targets during ball play;

(c) an electronic digital processor for energizing said scoring indicators to manifest said scoring values in response to said actuation of said scoring targets;

(d) a time display controlled by the processor for generating time indicia having values representative of the amount of ball play time remaining for a given player;

(e) player controlled means for generating bonus signals to said processor during selected game play conditions; and (f) said processor being responsive to said bonus signals input by one of said players for changing the time indicia of another of said multiple players.

5. A pinball game machine in which the game play is defined by a succession of ball plays and the duration of game play is determined by time rather than the number of ball plays, comprising:

(a) a playfield, scoring targets thereon, and scoring indicators associated therewith for indicating scoring values according to actuation of said scoring target;

(b) a ball for moving on the playfield and engaging and actuating the scoring targets during ball play;

(c) a processor for energizing said scoring indicators to manifest said scoring values in response to said actuation of said scoring targets;

(d) a time display controlled by the processor for generating time indicia having values which change from an initial value at a variable instantaneous rate determined by said actuation of said scoring targets; and (e) said processor including means for ending game play according to the value of said time indicia.

6. The pinball game machine according to claim 5, wherein said time indicia have values decreasing in magnitude.

7. The pinball game machine according to claim 5 wherein said processor includes a time register and a rate register, the time register being coupled to the time display for generating said time indicia thereto and said rate register having a rate value of magnitude responsive to actuation of said scoring targets, said processor further including means for changing the value of said time indicia when said rate value reaches a predetermined rate value.

8. The pinball game machine according to claim 7 and further including a plurality of operator adjustable switches coupled to said processor for setting said predetermined rate value.

9. The pinball game machine according to claim 7 and further including a plurality of operator adjustable switches coupled to the processor for setting said initial value of said time indicia.

10. The pinball game machine according to claim 5 and including an outhole detector on said playfield for detecting when said ball leaves the playfield at the end of ball play, and wherein said processor is responsive to ball actuation of said outhole detector for terminating game play upon the added condition that the time indicia value has reached a game over value which is a differential of predetermined magnitude from said initial value.

11. The pinball game machine according to claim 10 wherein said processor is responsive to ball actuation of said outhole detector to increase said differential by a predetermined penalty value.

12. The pinball game machine according to claim 11 and including a plurality of operator adjustable switches coupled to said processor for setting said predetermined penalty value.

13. The pinball game machine according to claim 5 wherein said time display changes from said initial value to a game-over value and further including a sound mechanism coupled to said processor for generating different audio indicia as said time indicia values change from the initial value to the game-over value, thereby to audibly indicate to the player how much game play time he has remaining.

14. A multiple-player, single-player-at-a-time pinball game machine in which game play for a given player is defined by a succession of ball plays by that player, comprising:

(a) a playfield, scoring targets thereon, and scoring indicators associated therewith for indicating scoring values according to actuation of said scoring target;

(b) a ball for moving on the playfield and engaging and actuating the scoring targets during ball play;

(c) a processor for energizing said scoring indicators to manifest said scoring values in response to said actuation of said scoring targets;

(d) a time display controlled by the processor for generating time indicia, said display having means to change the values of the time indicia at a variable instantaneous rate determined by said actuation of said scoring targets;

(e) player controlled means for generating bonus signals to said processor upon certain play conditions; and (f) said processor being responsive to said bonus signals input by one of said multiple players for changing the time indicia of another of said multiple players.

15. The pinball game machine according to claims 2 or 14 wherein said processor comprises means responsive to said bonus signals for changing the scoring values of another player.

16. The pinball game machine according to claims 1, 4, or 14 wherein said player controlled means are flippers.

17. The pinball game machine according to claim 14, wherein said processor changes the time indicia of another said multiple players by either enlarging or diminishing the value thereof.

18. A pinball game machine in which the game play is defined by a succession of ball plays and the duration of game play is determined by time and not the number of ball plays, comprising:

(a) a playfield, scoring targets thereon, and scoring indicators associated therewith for indicating scoring values according to actuation of said scoring target;

(b) a ball for moving on the playfield and engaging and actuating the scoring targets during ball play;

(c) a set of operator controlled flippers for propelling the ball on the playfield;

(d) at least another operator controlled flipper and a second set of scoring targets on the playfield selectively operable during ball play for also controlling operation of said scoring indicators;

(e) a processor for energizing said scoring indicators to manifest said scoring values in response to said actuation of said scoring targets;

(f) a time display controlled by the processor for generating time indicia having changing values according to the duration of game play remaining; and (g) said processor being coupled to said second set of flippers for suspending said changing of time values on said time display during energization of said second set of flippers.

19. The pinball game machine according to claim 18, wherein there is only a single ball at any given time on said playfield during game play.

20. An electronic digital processor controlled pinball game machine where a player plays at least in part against the electronic digital processor, comprising:

(a) a playfield having ball operated scoring targets thereon;

(b) a ball for moving on the playfield and engaging and actuating the scoring targets during ball play;

(c) a plurality of indicators for manifesting values representing the play status of a given player during his game play;

(d) an electronic digital processor for energizing said indicators to manifest player play status values which change during ball play;

(e) said processor further being responsive to the ball play of a given player to energize at least one of said indicators to manifest a processor play status value representing a changing play status condition to describe simulated play of the processor; and (f) said processor coupled to yet another indicator for indicating a bonus condition for a player when the player play status value achieves a predetermined relationship, as determined by said processor, to that of the processor play status value.

21. The electronic digital processor controlled pinball game machine according to claim 20 wherein game play is defined by a succession of ball plays and the duration of game play is determined by time rather than the number of ball plays, and wherein another one of said indicators is responsive to said processor to represent a changing value of time.

22. The electronic digital processor controlled pinball game machine according to claim 20 wherein said play status values are score values.

23. The electronic digital processor controlled pinball game machine according to claim 20 wherein said predetermined relationship is either the player's scoring value equaling the processor's scoring value.

24. The electronic digital processor controlled pinball game machine according to claim 20 wherein the indicators are a plurality of lamps corresponding to the player's play status.

25. The electronic digital processor controlled pinball game according to claim 20 wherein said predetermined relationship is the player's scoring value exceeding the processor's scoring value.

26. A pinball game machine comprising:

(a) a playfield, a ball for rolling on the playfield, score targets on the playfield, scoring indicators for manifesting score values in response to ball actuation of the scoring targets and first and second flipper mechanisms on the playfield for propelling the ball thereon in response to player actuation; and (b) a control mechanism for operating said first and second flipper mechanisms in response to player inputs, said control mechanisms including means for alternately operating either the first or the second flipper mechanisms during different time periods.

27. The pinball game machine according to claim 26 wherein the control mechanism comprises a single pair of player operated button switches for operating the first and second flipper mechanisms.

28. The pinball game machine according to claim 27 wherein said control mechanism enables operation of the first flipper mechanism for a predetermined maximum period of time.

29. The pinball game machine according to claim 28 wherein said control mechanism enables operation of the second flipper mechanism for periods not having a time maximum.

30. The pinball game machine according to claim 26 wherein the playfield includes first and second play areas and the first flipper mechanism is disposed in the first play area and the second flipper mechanism is disposed in the second play area and said control mechanism enables operation of the first flipper mechanism when the ball is in the first play area and enables operation of the second flipper mechanism when the ball is in the second play area.

31. The pinball game machine according to claim 30 wherein said first play area includes at least one of said targets, and wherein said control mechanism is responsive to the ball engaging said target to commence said predetermined period of time.

32. The pinball game machine according to claim 30 wherein said first play area includes a passageway to allow the ball to pass from said first play area and includes means for detecting when the ball passes from said first play area, and wherein said control mechanism is responsive to said detecting means for disabling said first flipper mechanism prior to said maximum time period.

33. The pinball game machine according to claim 32 wherein said selecting means is a roll-over switch.

34. A pinball game machine in which the game play is defined by a succession of ball plays and the duration of game play is determined by time rather than the number of ball plays, comprising:

(a) a playfield, scoring targets thereon, and scoring indicators associated therewith for indicating scoring values according to actuation of said scoring target;

(b) a ball for moving on the playfield and engaging and actuating the scoring targets during ball play;

(c) a processor for energizing said scoring indicators to manifest said scoring values in response to said actuation to said scoring targets;

(d) a time display controlled by the processor for generaing time indicia having values which change from an initial value to a game-over value;

(e) said processor including means for ending game play according to the value of said time indicia; and (f) a sound generator controlled by said processor to generate different sounds during game play indicative of the value of said time indicia, thereby providing an audio indication of the duration of game play remaining.

35. The pinball game machine according to claim 34 and including means for detecting when the ball leaves the playfield at the end of ball play and said processor is coupled to said detecting means to end game play upon ball actuation of the detecting means and upon the time indicia reaching game-over value, and wherein said sound generator is operated by said processor to generate a unique sound upon the condition the time indicia has reached game over value but prior to the ball engaging the detecting means, thereby indicating to the player that game play is terminated after the ball play.

36. In a pinball game of the type having a playfield, a ball rolling thereon, ball actuable scoring targets on the playfield, visual indicators for manifesting values responsive to actuation of the scoring targets, and a processor for operating the visual indicators in response to actuation of the scoring targets after commencement of, and during, game play, the improvement comprising:

(a) sound generator operated by the processor to emit sounds which change with the passage of time after commencement of game play to thereby provide an indication of the amount of game play remaining.

37. A digital processr controlled pinball game machine comprising:

(a) a playfield, a plurality of balls rolling on said playfield, ball actuable scoring targets on said playfield, a processor, and visual indicators operated by the processor for manifesting values in response to ball actuation of the scoring targets;

(b) means on said playfield defining at least first and second play areas, each said play area having its own ball flipper mechanism coupled to the processor for propelling the respective ball within the respective play area, thereby defining ball play; and (c) one or more scoring targets in each play area which are coupled to the processor and which are actuated only by the ball of the respective play area, said defining means confining movement of the respective balls to only the respective play area, said processoring including means for enabling ball play in one of said play areas for only a limited duration of time.

38. The pinball game machine according to claim 37 wherein said processor includes means to commence ball play in said one play area upon a game condition in said other play area.

39. The pinball game machine according to claim 37 wherein said processor includes means for limiting ball play in each play area to a determined amount of time.

40. The pinball game machine according to claim 37 and including a player operated switch mechanism for operating the flipper mechanism in both play areas.

41. The pinball game machine according to claim 40 wherein the player operated switch mechanism is a single set of pushbutton switches.

42. The pinball game machine according to claim 37 wherein the processor includes means to operate the indicators to be responsive to ball actuation of the scoring targets independently of whether the scoring targets are disposed in one play area or the other.

43. The pinball game machine according to claim 37 wherein the processor includes means for operating the scoring targets in the play areas alternately.

44. The pinball game machine according to claim 37 wherein the processor includes means for operating the scoring targets in the play areas concurrently.

45. A pinball game machine in which the game play is defined by a succession of ball plays and the duration of game play is determined at least on part by time rather than the number of ball plays, comprising:

(a) a playfield including means defining at least first and second play areas, scoring targets in each play area, and scoring indicators associated therewith for indicating scoring values according to actuation of said scoring targets;

(b) a plurality of balls for moving on the playfield and engaging and actuating the scoring targets during ball play, said defining means confining movement of a given ball to only the respective play area;

(c) first and second flipper mechanisms associated respectively with each said play area for propelling the ball against the respective scoring targets;

(d) an electronic digital processor for energizing said scoring indicators to manifest said scoring values in response to said actuation of the scoring targets; and (e) a time display controlled by the processor for generating time indicia having value representative of the amount of ball play time remaining for a given player whereby the processor includes means for altering the values of the time indicia in response to actuation of the scoring targets during ball play.

46. A digital processor controlled pinball game machine comprising:

(a) at least first and second play areas, at least one ball for said play areas, ball actuable scoring targets on said play areas, a processor, and visual indicators operated by the processor for manifesting values in response to ball actuation of the scoring targets, each said play area having its own ball flipper mechanism coupled to the processor for propelling the ball within the respective play area, thereby defining ball play; and (b) said processor including means for enabling ball play in one of said play areas for only a limited duration of time.

47. The pinball game machine according to claim 46 and including one or more scoring targets in each play area which are coupled to the processor and which are actuated by ball engagement only during ball play in the respective play area.

* * * * *

UNITED STATES PATENT OFFICE
CERTIFICATE OF CORRECTION

Patent No. 4,363,485 Dated December 14, 1982

Inventor(s) Allen G. Edwall

It is certified that error appears in the above-identified patent and that said Letters Patent are hereby corrected as shown below:

Column 1, line 38, change "electrochemical" to -- electro-mechanical --.

Column 5, line 51, change "adjustment" to -- adjustable --.

Column 6, line 18, change "commenced" to -- commence --.

Column 7, line 46, change "rate" to -- rare --.

Column 9, line 27, change "player'S" to -- player's --.

Column 16, line 2, after "status" and before the period, insert -- and to the processor's play status --.

Column 17, line 2, change "generaing" to -- generating --.

Column 18, line 20, change "on" to -- in --.

Signed and Sealed this

*Nineteenth* Day of *April 1983*

[SEAL]

*Attest:*

GERALD J. MOSSINGHOFF

*Attesting Officer*

*Commissioner of Patents and Trademarks*